US006418820B1

(12) United States Patent
Lamond et al.

(10) Patent No.: US 6,418,820 B1
(45) Date of Patent: Jul. 16, 2002

(54) ERGONOMIC HANDLE FOR A WRENCH

(75) Inventors: Donald R. Lamond, Haworth, NJ (US); Richard Whitehall, New York, NY (US); David Schiff, Highland Park, NJ (US)

(73) Assignee: WKI Holding Company Inc., Elmira, NY (US)

( * ) Notice: Subject to any disclaimer, the term of this patent is extended or adjusted under 35 U.S.C. 154(b) by 0 days.

(21) Appl. No.: 09/815,689

(22) Filed: Mar. 23, 2001

(51) Int. Cl.[7] ..... B25B 23/16
(52) U.S. Cl. ..... 81/177.1; 81/489
(58) Field of Search ..... 81/177.1, 489; 16/110.1, 430; D8/107, DIG. 7

(56) References Cited

U.S. PATENT DOCUMENTS

| | | | | |
|---|---|---|---|---|
| D42,622 | S | | 6/1912 | Gafinowitz |
| D47,435 | S | | 6/1915 | Petersen |
| D49,548 | S | | 8/1916 | Richard, Jr. |
| D94,697 | S | | 2/1935 | Krause |
| D96,002 | S | | 6/1935 | Amrine |
| 2,100,034 | A | | 11/1937 | Leonard |
| D193,202 | S | | 7/1962 | Eckersberg |
| D198,197 | S | | 5/1964 | Utz |
| 3,263,534 | A | | 8/1966 | Webbeking |
| D222,872 | S | | 1/1972 | Boucher |
| D241,604 | S | | 9/1976 | Ward |
| 4,106,372 | A | | 8/1978 | Miller |
| 4,454,791 | A | | 6/1984 | Seward, III |
| 4,653,357 | A | | 3/1987 | Carlmark |
| 4,735,121 | A | | 4/1988 | Coulson |
| 4,974,286 | A | * | 12/1990 | Stowell et al. ..... 81/177.1 |
| D318,602 | S | | 7/1991 | Vosbikian |
| 5,375,490 | A | | 12/1994 | Carlmark |
| D375,035 | S | | 10/1996 | Mangol |
| 5,595,095 | A | * | 1/1997 | Hillinger ..... 81/60 |
| 5,740,586 | A | | 4/1998 | Gomas |
| 5,791,055 | A | | 8/1998 | Mangol |
| 5,852,960 | A | * | 12/1998 | Wu ..... 81/177.1 |
| 5,873,148 | A | * | 2/1999 | Arnold ..... 81/177.1 |
| 6,003,413 | A | * | 12/1999 | Macor ..... 81/489 |
| 6,116,122 | A | * | 9/2000 | Lien-Sheng ..... 81/177.1 |
| 6,125,725 | A | | 10/2000 | Fox et al. |
| 6,247,385 | B1 | * | 6/2001 | Wu ..... 81/177.1 |
| D447,040 | S | * | 8/2001 | Douglas et al. ..... D8/107 |

* cited by examiner

*Primary Examiner*—Eileen P. Morgan
*Assistant Examiner*—Joni B. Danganan
(74) *Attorney, Agent, or Firm*—Burr & Brown

(57) ABSTRACT

An ergonomic wrench for rotating a member in a torquing plane substantially perpendicular to the axis of rotation of the member is provided, having a head portion for engaging the member and a handle extending therefrom in a first longitudinal direction. The invention further includes a handle which is substantially elliptical, having a major axis and a minor axis when viewed in a cross-sectional plane perpendicular to said first longitudinal direction, the major axis of which is arranged substantially perpendicular to the torquing plane.

10 Claims, 3 Drawing Sheets

ERGONOMIC HANDLE FOR A WRENCH

FIELD OF THE INVENTION

The invention relates to a handle for a wrench for rotating a member (e.g., a nut) in a torquing plane substantially perpendicular to the axis of rotation of the member. The invention, in particular, relates to such a wrench having an ergonomically designed handle to reduce stress and increase productivity during use.

BACKGROUND OF THE INVENTION

A typical prior art crescent wrench is shown in FIG. 5. The wrench includes a head portion 100 for engaging a member, such as a nut or the head of a bolt, and a handle portion 200 for applying torquing force to the member in a direction which is substantially coplanar with a torquing plane lying in the major plane of the wrench body. Since the handle portion 200 is substantially planar, it presents a problem in that the greatest amount of stress is concentrated at the thinnest part of the handle. That is, a user's hand presses against the thinnest part of the handle when the wrench is pushed or pulled in the torquing plane. Extended use of the wrench can cause significant discomfort and potential injuries from repetitive manipulation. This discomfort can cause improper and inefficient use of the tool.

A wrench having a cylindrical handle portion is also known. However, the cylindrical handle also places a high stress concentration on the hand, causing serious discomfort and preventing proper performance of the torquing movement facilitated by using the tool. Such improper use may cause further injury and increase the time required to complete a project for which the tool is intended.

Other tools, such as hammers, include handles which are generally elliptical in cross-section. In these cases, the major axis of the ellipse is arranged such that it is coplanar with the direction of the applied force. This orientation of the elliptically shaped handle is intended to provide more comfort than a planar or circular handle when held in the palm and gripped by the fingers. While this design may present a more appealing tactile feel when the tool is first gripped, if employed in a wrench handle it would concentrate the stress on the part of the handle having the least surface area, since the major axis of the elliptical handle is coplanar with the direction of the applied force. Accordingly, this orientation of an elliptical handle, if used in a wrench which is pushed or pulled in a torquing plane, would accentuate the problem discussed above, since the thinnest part of the ellipse receives the applied force. Accordingly, the problem of discomfort, injury, improper use, and decreased efficiency would not be solved by incorporating a handle of this type.

It would be desirable to provide a wrench having an ergonomic handle that is comfortable to hold, and functions to reduce physical stress and injury during use, while at the same time facilitating proper use and increased efficiency. No attempts have been made to address these problems in the area of wrenches as defined above.

SUMMARY OF THE INVENTION

It is an object of the present invention to overcome the drawbacks of the prior art, particularly to provide a wrench for rotating a member in a torquing plane substantially perpendicular to the axis of rotation of the member having an ergonomic handle which facilitates proper and efficient use of the wrench by reducing the stress placed on the hand and arm.

In accordance with one object of the present invention, a wrench for rotating a member in a torquing plane substantially perpendicular to the axis of rotation of the member is provided, including a head portion for engaging a member, such as a bolt, and a handle extending from the head portion in a first longitudinal direction. The handle is substantially elliptical, having a major axis a and a minor axis b when viewed in a cross-sectional plane perpendicular to the first longitudinal direction, and the major axis a is arranged substantially perpendicular to the torquing plane.

In accordance with another embodiment of the present invention, a wrench for rotating a member in a torquing plane substantially perpendicular to the axis of rotation of the member is provided, having a head portion for engaging a member, a handle extending therefrom in a first longitudinal direction, and an elongate main body portion extending from the head portion and passing through the handle portion in the first longitudinal direction. The main body portion, when viewed in the cross-sectional plane perpendicular to the first longitudinal direction, is substantially planar and extends in a second direction that is substantially coplanar with said torquing plane.

In accordance with a third embodiment of the present invention, a wrench for rotating a member in a torquing plane substantially perpendicular to the axis of rotation of the member is provided, having a head portion for engaging a member, and a main body portion formed integrally with the head portion.

In accordance with a preferred embodiment of the present invention, a wrench for rotating a member in a torquing plane substantially perpendicular to the axis of rotation of the member is provided, having a head portion for engaging a member and an elongate main body portion extending therefrom in a first longitudinal direction. The wrench further includes a handle formed separately from the head portion and the main body portion, and the handle is assembled over the main body portion.

In accordance with another embodiment of the present invention, a wrench for rotating a member in a torquing plane substantially perpendicular to the axis of rotation of the member is provided, having a head portion for engaging a member and a handle extending therefrom in a first longitudinal direction. The handle being substantially elliptical in shape, essentially fulfills the equation $x^2/a^2+y^2/b^2=1$, where a>b, and the ratio of a:b ranges from 1.10:1 to 1.25:1.

In accordance with another embodiment of the invention, a wrench for rotating a member in a torquing plane substantially perpendicular to the axis of rotation of the member is provided, having a head portion for engaging a member and a handle extending therefrom in a first longitudinal direction. The handle includes an inner core extending along the first longitudinal direction and having an inner surface which opposing the main body portion of the wrench, and an external layer extending along the first longitudinal direction and substantially covering an outer surface of the inner core.

In accordance with yet another embodiment of the invention, a wrench for rotating a member in a torquing plane substantially perpendicular to the axis of rotation of the member is provided, having a head portion for engaging a member and a handle extending therefrom in a first longitudinal direction. The handle includes an inner core extending along the first longitudinal direction and having an inner surface which opposing the main body portion of the wrench, and the inner core comprises a hard grade elastomer material.

In accordance with another embodiment, a wrench for rotating a member in a torquing plane substantially perpendicular to the axis of rotation of the member is provided, having a head portion for engaging a member and a handle extending therefrom in a first longitudinal direction. The handle includes an inner core extending along the first longitudinal direction and having an inner surface which opposing the main body portion of the wrench, and the inner core comprises a hard grade elastomer material, such as a polypropylene material.

In accordance with still another embodiment, a wrench for rotating a member in a torquing plane substantially perpendicular to the axis of rotation of the member is provided, having a head portion for engaging a member and a handle extending therefrom in a first longitudinal direction. The handle includes an inner core extending along the first longitudinal direction and an external layer extending along the first longitudinal direction and substantially covering an outer surface of the inner core, and the external layer comprises a flexible grade elastomeric material.

BRIEF DESCRIPTION OF THE DRAWINGS

For a fuller understanding of the nature and objects of the invention, reference should be made to the following detailed description of a preferred mode of practicing the invention, read in conjunction with the accompanying drawings, in which.

DETAILED DESCRIPTION OF THE INVENTION

Figure 1:
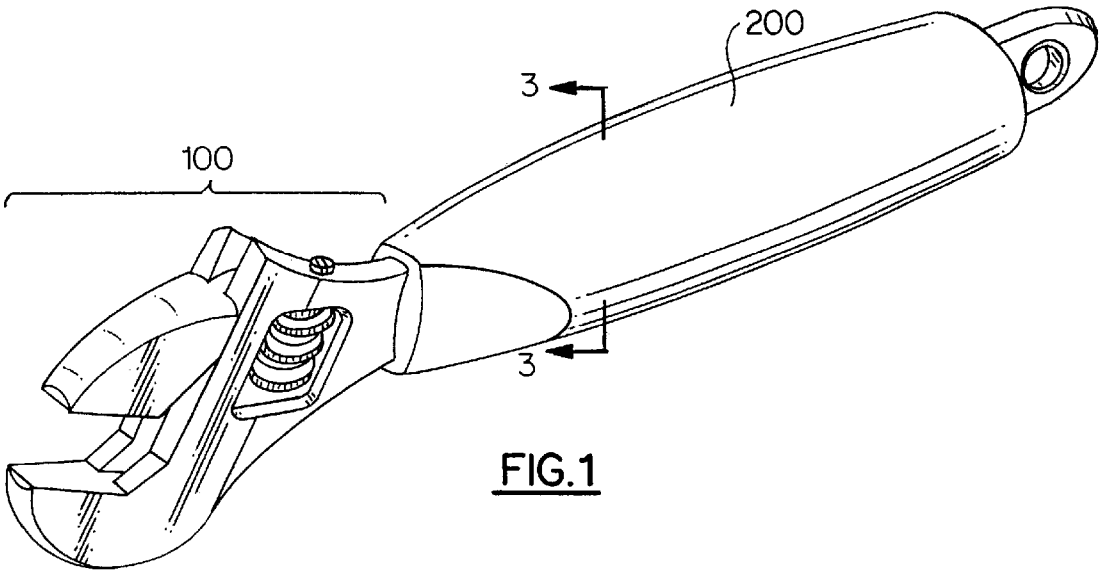
FIG. 1 is a perspective view of a wrench according to one embodiment of the present invention;.

FIG. 1 is a perspective view of a wrench according to one embodiment of the present invention. The wrench includes a head portion 100 for gripping or otherwise engaging a member, such as a nut or a bolt. When engaged with the wrench, the member is rotated in a torquing plane perpendicular to the axis of rotation of the member. The wrench also includes a handle 200 extending from the head portion 100 in a first longitudinal direction substantially parallel to, or essentially lying within, the torquing plane.

Figure 2:
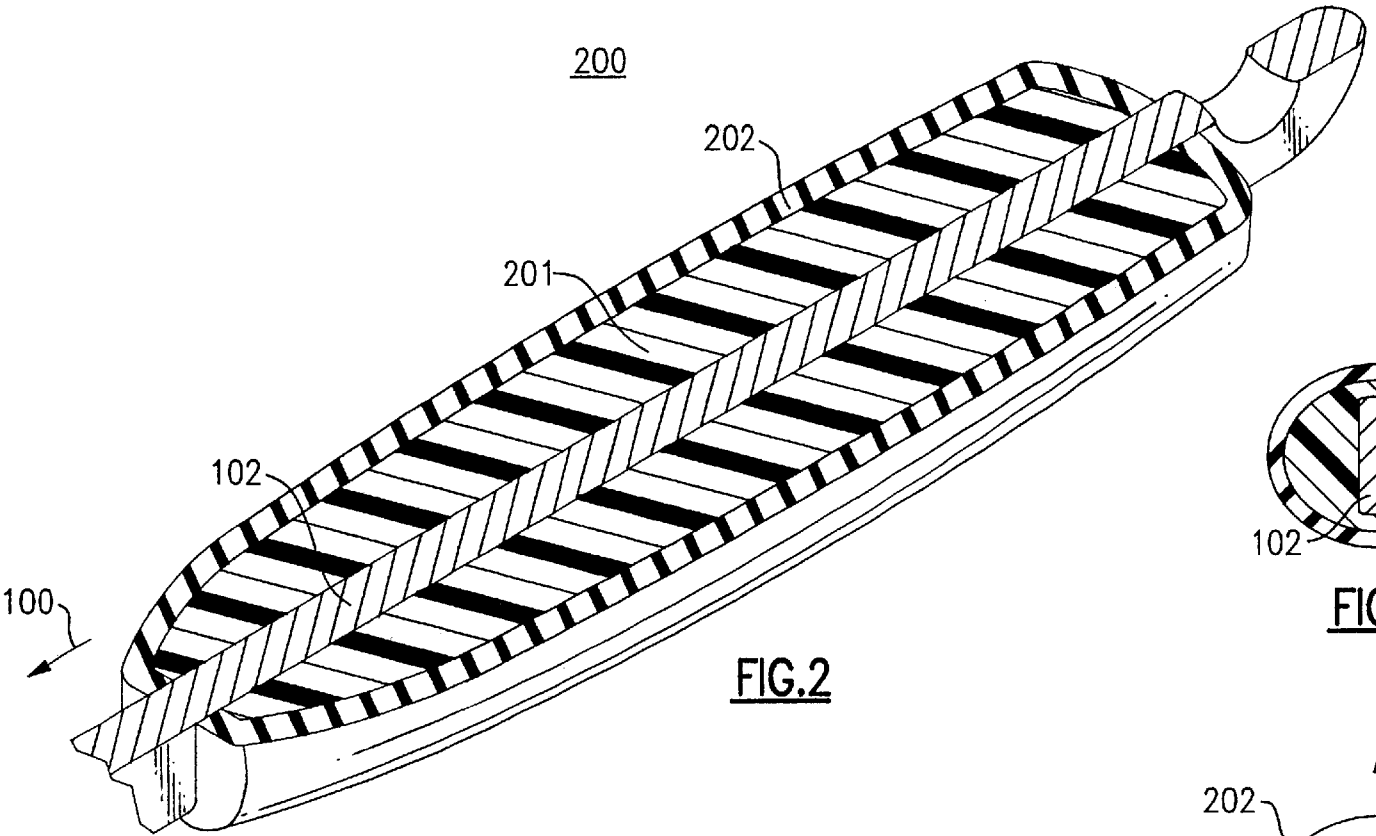
FIG. 2 is a longitudinal cross-sectional perspective view of the handle portion of the wrench shown in FIG. 1.

FIG. 2, read in connection with the corresponding view in FIG. 1, is a longitudinal cross-sectional perspective view of the handle 200 of a wrench in accordance with one embodiment of the present invention. The handle 200 includes a main body portion 102 extending from a head portion 100 in a first longitudinal direction substantially parallel to the torquing plane. The handle 200 further includes an inner core 201 in intimate contact with the main body portion 102 along the first longitudinal direction. The handle also includes an external layer 202 situated around the inner core 201 in continuous intimate contact therewith.

It is desirable that the inner core 201 be a rigid material to provide shape and mechanical strength and support for the handle portion 200, while the external layer 202 is preferably made of a soft, slightly deformable material to aid gripping and provide the desired tactile feel. The inner core 201 and the external layer 202 are substantially chemically bonded at the interface. Further, it is preferred that the main body portion 102 is embedded within, or substantially surrounded by, the inner core 201 of the handle 200, such that the main body portion 102 is not in direct contact with the external layer 202. This is desired because the handle portion 200 could move independently of the main body portion 102 upon the application of force since the external layer 202 and the main body portion 102 do not share a chemically bonded interface.

In a preferred embodiment of the present invention, the head portion 100 and the main body portion 102 are integrally formed from substantially the same material by any conventional method, an example of which is forging. The handle portion 200 is formed as a subassembly separately and mechanically affixed to the main body portion 102.

That is, the handle 200 subassembly includes an inner core 201 formed by molding, and an external layer 202 which is then over-molded on the inner core 201. The handle subassembly is then attached to the main body portion 102 as explained in commonly assigned co-pending application Ser. No. 09/815,690, entitled "Self-Securing Tool Handle," filed contemporaneously herewith.

The head portion 100 is made from any conventionally used material, including but not limited to steel. Likewise, the main body portion 102 is made from any conventionally used material, including but not limited to steel. The inner core 201 is preferably made from a hard grade polymeric material, suitable examples of which include polypropylene and ABS. The external layer 202 is preferably a flexible, soft elastomeric material, an example of which is Santoprene.

Figure 3:
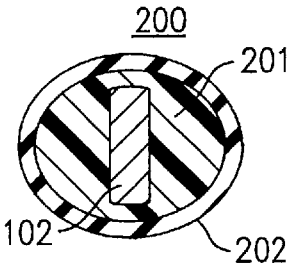
FIG. 3 is a cross-sectional view of the wrench shown in FIG. 1 taken along the plane III—III in accordance with an embodiment of the present invention.

FIG. 3, read in connection with the corresponding view in FIG. 1, shows a cross-sectional view of the handle 200 taken along plane III—III, which is substantially perpendicular to the first longitudinal direction of the main body portion 102. The inner core 201 substantially surrounds main body portion 102, and the external layer 202 substantially surrounds the inner core 201.

Figure 4:
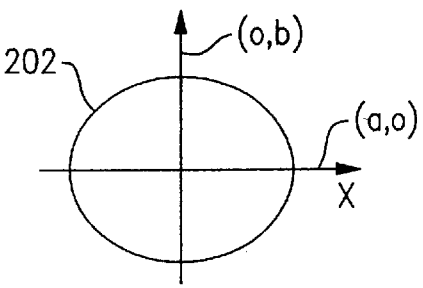
FIG. 4 is a diagram of an ellipse tracing the outer periphery of the handle illustrated in FIG. 3 shown on an x-y axis.
Figure 5:
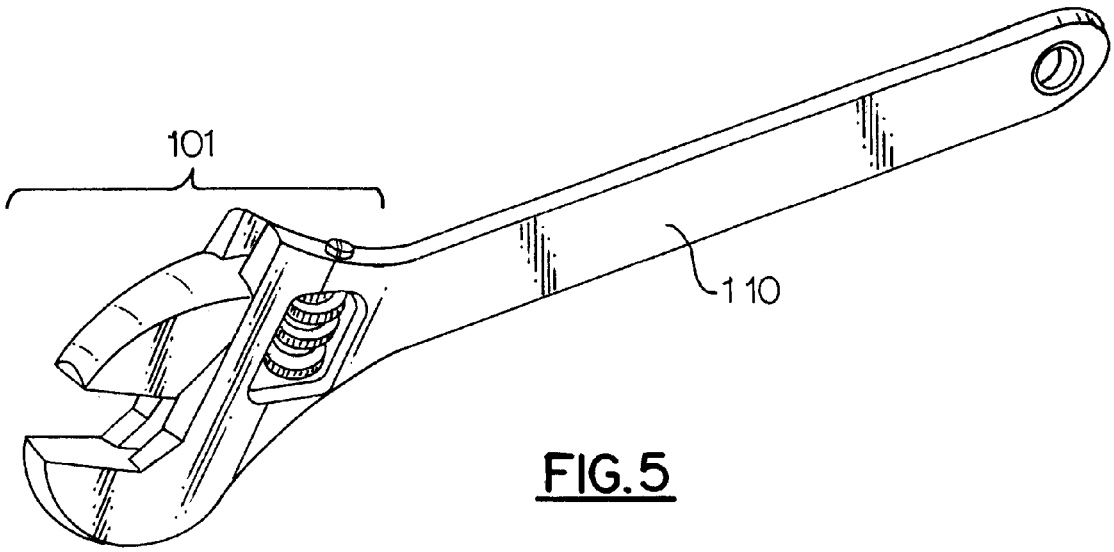
FIG. 5 is a perspective view of a prior art wrench.

FIG. 4 is a diagram of an ellipse having the formula $x^2/a^2+y^2/b^2=1$, shown here intersecting the x-axis at (a,0) and (−a,0) and intersecting the y-axis at (0,b) and (0,−b). The ellipse of FIG. 4 traces the periphery of the external layer 202 of the handle 200 when viewed in cross-section as shown in FIG. 3. When read in conjunction with FIG. 3, the main body portion 102 extends substantially along the y-axis, or in a direction parallel thereto, along such a plane that is also coplanar with the torquing plane. The width of the handle 200 extends substantially along the x-axis, or in a direction parallel thereto, along such a plane that is also perpendicular with the torquing plane.

That is, the substantially elliptical handle 200 is generally oriented such that the width is substantially parallel to the x-axis as shown in FIG. 4, and the height, is substantially parallel to the y-axis. The points at which the handle 200 intersect the x and y-axes define the points a and b of the ellipse in FIG. 4., where a is greater than b. In particular, the ratio of a:b ranges from 1.10:1 to 1.25:1. More preferably, the ratio of a:b is 1.20:1.

Since the width of the substantially elliptical handle 200 is perpendicular to the direction in which the torquing force is applied upon a member by the wrench, the stress incurred during use is distributed along the handle surface having the greatest surface area, and is not concentrated over the smallest surface area, as is the case with substantially planar and circular handles. That is, when held within the gripping palm, the fingers encircle the major axis of the substantially elliptical handle 200, and the force exerted by the hand onto the handle 200 is more efficiently directed to levering the wrench so that the tool can rotate the member gripped by the head portion 100.

When held properly so that the wrench can act upon the desired member in the correct manner, the handle of the wrench of the present invention feels different than handles found in the prior art. Force is generally exerted from the arm onto the flat part of the palm when using such a tool, and since the flat part of the palm is in substantial gripping contact with a greater area of the surface of the handle in the present invention, the wrench is more comfortable to use. It is in this way that the wrench handle of the present invention does not pinch the palm when gripped, even upon the application of significant force, such as that required to loosen a rusted nut or bolt. Likewise, the increased comfort prevents stress fatigue and injury which the hand, wrist, and arm can incur after strenuous or extended use.

While the present invention has been particularly shown and described with reference to the preferred mode as illustrated in the drawings, it will be understood by one skilled in the art that various changes may be effected therein without departing from the spirit and the scope of the invention as defined by the claims.

We claim:

1. A wrench for rotating a member in a torquing plane substantially perpendicular to the axis of rotation of the member, said wrench comprising:

a head portion for engaging the member;

a handle extending from said head portion in a first longitudinal direction, said handle being substantially elliptical, having a major axis and a minor axis, when viewed in a cross-sectional plane perpendicular to said first longitudinal direction, wherein the major axis is arranged substantially perpendicular to said torquing plane; and an elongate main body portion extending from said head portion and passing through said handle in said first longitudinal direction wherein said main body portion, when viewed in said cross-sectional plane, is substantially planar, and extends in a second direction that is substantially coplanar with said torquing plane.

2. The wrench of claim 1, wherein said main body portion is formed integrally with said head portion.

3. The wrench of claim 1, wherein said handle is formed separately from said head portion and said main body portion, and is then assembled over said main body portion.

4. The wrench of claim 1, wherein said handle idler comprises:

an inner core extending along said first longitudinal direction, said inner core having an inner surface which opposed said main body portion of said wrench; and an external layer extending along said first longitudinal direction and substantially covering an outer surface of said inner core.

5. The wrench of claim 4, wherein said inner core comprises a hard grade elastomer material.

6. The wrench of claim 4, wherein said inner core comprises a polypropylene material.

7. The wrench of claim 4, wherein said external layer comprises a flexible grade elastomeric material.

8. The wrench of claim 4, wherein said external layer comprises Santoprene.

9. The wrench of claim 1, wherein the cross-sectional shape of said substantially elliptical handle fulfills the equation $x^2/a^2+y^2/b^2=1$, wherein a>b, and the ratio of a:b ranges from 1.10:1 to 1.25:1.

10. The wrench of claim 9, wherein said ratio of a:b is 1.20:1.

* * * * *